US008511217B2

(12) United States Patent
Andersen et al.

(10) Patent No.: US 8,511,217 B2
(45) Date of Patent: Aug. 20, 2013

(54) CLAMPING LEVER AND END CAP FOR RODLESS CYLINDERS

(75) Inventors: Michael Andersen, Krefeld (DE); Martin Engels, Alpen (DE); Gerhard Bohmer, Wesel (DE)

(73) Assignee: Norgren GmbH, Alpen (DE)

( * ) Notice: Subject to any disclaimer, the term of this patent is extended or adjusted under 35 U.S.C. 154(b) by 991 days.

(21) Appl. No.: 12/532,676

(22) PCT Filed: Apr. 3, 2007

(86) PCT No.: PCT/EP2007/002990

§ 371 (c)(1),
(2), (4) Date: Sep. 23, 2009

(87) PCT Pub. No.: WO2008/119367

PCT Pub. Date: Oct. 9, 2008

(65) Prior Publication Data

US 2010/0031814 A1 Feb. 11, 2010

(51) Int. Cl.
*F01B 29/08* (2006.01)

(52) U.S. Cl.
USPC ..... 92/88

(58) Field of Classification Search
USPC ..... 92/88
See application file for complete search history.

(56) References Cited

U.S. PATENT DOCUMENTS

| | | | |
|---|---|---|---|
| 6,098,522 | A | 8/2000 | Granberg |
| 2002/0157923 | A1 | 10/2002 | Kaneko |

FOREIGN PATENT DOCUMENTS

| | | | |
|---|---|---|---|
| DE | 19846621 | A1 | 5/1999 |
| JP | 03004005 | | 10/1991 |

*Primary Examiner* — F. Daniel Lopez
(74) *Attorney, Agent, or Firm* — The Ollila Law Group LLC

(57) ABSTRACT

The present invention relates to an end cap for a rodless cylinder (101) provided with a sealing strip (110). The end cap comprises an end cap body (102, 104) and a channel (105). The end cap body (102, 104) is configured to sealingly fit to a cylinder body (101). The channel (105) is formed in the end cap body (102, 104) and adapted to receive the sealing strip (110). The end cap includes a clamping lever (15) pivotally affixed to the end cap body (102, 104), with the clamping lever (15) including a clamping surface (90) that clamps the sealing strip (110) within the channel (105) when the clamping lever (15) is moved to a substantially closed position.

38 Claims, 11 Drawing Sheets

CLAMPING LEVER AND END CAP FOR RODLESS CYLINDERS

FIELD OF THE INVENTION

The present invention relates to a clamping device for fluid actuated rodless cylinders.

BACKGROUND OF THE INVENTION

Fluid actuated rodless cylinders are useful for moving work-pieces. Rodless cylinders include a displaceable piston that is located within a generally cylindrical or non-cylindrical main body. The piston is typically connected to a slider via a piston yoke. The slider is located, at least in part, outside the cylindrical main body. When hydraulic or pneumatic displacement of the piston occurs, the slider and the work-piece move along the axial length of the cylindrical body.

Since hydraulic and pneumatic actuated rodless cylinders use fluid or air to displace the piston, it is important that the main body be leakage proof. In order to prevent leakage, rodless cylinders generally include a pair of end caps and a sealing strip. The end caps are located at the end of the main body and the sealing strip extends axially along the main body between the end caps.

The current methods of securing the seals to the main body include a large number of parts, which are time consuming to assemble. The present invention is directed to overcoming this and other disadvantages inherent in presently manufactured fluid actuated working cylinders.

SUMMARY OF THE INVENTION

The scope of the present invention is defined solely by the appended claims, and is not affected to any degree by the statements within this summary. Briefly stated, the present invention relates to an end cap for a rodless cylinder provided with a sealing strip. The end cap comprises an end cap body and a channel. The end cap body is configured to sealingly fit to a cylinder body. The channel is formed in the end cap body and adapted to receive the sealing strip. The end cap includes a clamping lever pivotally affixed to the end cap body, with the clamping lever including a clamping surface that clamps the sealing strip within the channel when the clamping lever is moved to a substantially closed position.

ASPECTS

One aspects of the invention includes, an end cap for a rodless cylinder including a sealing strip, the end cap comprising:

a) an end cap body configured to sealingly fit to a cylinder body;

b) a channel formed in the end cap body and adapted to receive the sealing strip; and c) a clamping lever pivotally affixed to the end cap body, with the clamping lever including a clamping surface that, at least partially, clamps the sealing strip within the channel when the clamping lever is moved to a substantially closed position.

Preferably, the channel comprises one or more walls formed into the end cap.

Preferably, the clamping lever is releasably secured to the channel on the end cap.

Preferably, one or more locking members provided on the clamping lever that releasably secure the clamping lever.

Preferably, at least one locking member on the clamping lever includes a stem and a hook that snap fit to the end cap.

Preferably, at least one locking member on the clamping lever includes a stem and a hook that snap fit to the clamping lever.

Preferably, a stop provided on the clamping lever that limits rotation of the clamping lever in a closed direction.

Preferably, the clamping surface is off center with respect to an axis of rotation of the clamping lever.

Preferably, the clamping lever places a tension force on the sealing strip when moved to the substantially closed position.

Preferably, an underside of the clamping lever includes a plurality of ribs that increase the rigidity of the clamping lever.

Preferably, an underside of the clamping lever includes a plurality of ribs that form a lattice structure that increases the rigidity of the clamping lever.

Preferably, the clamping lever further comprises:

a) a first section, a second section, and a flex area, wherein the flex area flexibly joins the first section to the second section;

b) the first section includes the clamping surface and is releasably secured to the end cap when the clamping lever is moved to the substantially closed position; and c) the second section is releasably secured to the first section when the clamping lever is moved to the substantially closed position.

Preferably, the end cap for a rodless cylinder, wherein:

a) the clamping lever includes a first section, a second section, and a flex area, wherein the flex area flexibly joins the first section to the second section;

b) the first section includes the clamping surface and is releasably secured to the end cap when the clamping lever is moved to the substantially closed position;

c) the second section is releasably secured to the first section when the clamping lever is moved to the substantially closed position; and d) the channel is provided with at least one overhang that extends over the second section of the clamping lever.

Preferably, the clamping lever further comprises:

a) a first section, a second section, and a flex area, wherein the flex area flexibly joins the first section to the second section;

b) the first section includes the clamping surface and first and second locking members that include stems and hooks, wherein the first and second locking members releasably secure the clamping lever to the channel when the clamping lever is moved to the substantially closed position; and c) the second section includes third and fourth locking members that include stems and hooks, wherein the third and fourth locking members releasably secure the second section to the first section when the clamping lever is moved to the substantially closed position.

Preferably, the end cap for a rodless cylinder, wherein:

a) the clamping lever includes a first section, a second section, and a flex area, wherein the flex area flexibly joins the first section to the second section;

b) the first section includes the clamping surface and first and second locking members that include stems and hooks, wherein the first and second locking members releasably secure the clamping lever to the channel when the clamping lever is moved to the substantially closed position;

c) the second section includes third and fourth locking members that include stems and hooks, wherein the third and fourth locking members releasably secure the second section to the first section when the clamping lever is moved to the substantially closed position; and d) the channel is provided with at least one overhang that extends over the second section of the clamping lever.

Another aspect of the invention comprises a rodless cylinder, comprising:

a) a cylinder body provided with a first end, a second end, and a slot;

b) a sealing strip configured to substantially seal the slot;

c) first and second end caps sealingly fitted to the first and second ends of the cylinder body, wherein:

i) first and second channels are formed in the first and second end caps and are configured to receive the sealing strip; and ii) first and second clamping levers are pivotally affixed to the first and second end caps and include clamping surfaces that, at least partially, clamp the sealing strip within the channels when the first and second clamping levers are moved to substantially closed positions.

Preferably, the channels comprise one or more walls formed into the end caps.

Preferably, the first and second clamping levers are releasably secured to the channels on the first and second end caps.

Preferably, at least one locking member on the first clamping lever and the second clamping lever that releasably secures the clamping levers.

Preferably, at least one locking member on the first clamping lever and the second clamping lever that includes a stem and a hook that snap fit to the end caps.

Preferably, at least one locking member on the first clamping lever and the second clamping lever that include a stem and a hook that snap fit to the first and second clamping levers.

Preferably, stops provided on the first and second clamping levers that limit rotation of the clamping levers in an open direction.

Preferably, the clamping surfaces on the first and second clamping levers are off center with respect to an axis of rotation of the clamping levers.

Preferably, an underside of the first and second clamping levers includes a plurality of ribs that increase the rigidity of the first and second clamping levers.

Preferably, an underside of the first and second clamping levers includes a plurality of ribs that form lattice structures that increase the rigidity of the first and second clamping levers.

Preferably, the first and second clamping levers further comprise:

a) first sections, second sections, and flex areas, wherein the flex areas flexibly join the first sections to the second sections;

b) the first sections include the clamping surfaces and are releasably secured to the end caps when the first and second clamping levers are moved to the substantially closed positions; and c) the second sections are releasably secured to the first sections when the first and second clamping levers are moved to the substantially closed positions.

Preferably, the rodless cylinder, wherein:

a) the first and second clamping levers further include first sections; second sections, and flex areas, wherein the flex areas flexibly join the first sections to the second sections;

b) the first sections include the clamping surfaces and are releasably secured to the end caps when the first and second clamping levers are moved to the substantially closed positions;

c) the second sections are releasably secured to the first sections when the first and second clamping levers are moved to the substantially closed positions; and d) the channels on the first and second end caps are provided with at least one overhang that extends over the second sections of the first and second clamping levers.

Preferably, the first and second clamping levers further comprise:

a) first sections, second sections, and flex areas, wherein the flex areas flexibly join the first sections to the second sections;

b) the first sections include the clamping surfaces and first and second locking members that include stems and hooks, wherein the first and second locking members on the first sections are releasably secured to the channels when the first and second clamping levers are moved to the substantially closed positions; and c) the second sections include third and fourth locking members that include stems and hooks, wherein the third and fourth locking members on the second sections are releasably secured to the first sections when the first and second clamping levers are moved to the substantially closed positions.

Preferably, the rodless cylinder, wherein:

a) the first and second clamping levers include first sections, second sections, and flex areas, wherein the flex areas flexibly join the first sections to the second sections;

b) the first sections include the clamping surfaces and first and second locking members that include stems and hooks, wherein the first and second locking members on the first sections are releasably secured to the channels when the first and second clamping levers are moved to the substantially closed positions;

c) the second sections include third and fourth locking members that include stems and hooks, wherein the third and fourth locking members on the second sections are releasably secured to the first sections when the first and second clamping levers are moved to the substantially closed positions; and d) the channels on the first and second end caps are provided with at least one overhang that extends over the second sections of the first and second clamping levers.

Another aspect of the invention comprises a rodless cylinder, comprising:

a) a cylinder body provided with a first end, a second end, and a slot;

b) a sealing strip configured to substantially seal the slot;

c) first and second end caps sealingly fitted to the first and second ends of the cylinder body, wherein:

i) first and second channels are formed in the first and second end caps and are configured to receive the sealing strip; and ii) first and second clamping levers are pivotally affixed to the first and second end caps and include clamping surfaces that, at least partially, clamp the sealing strip within the channels and apply tension to the sealing strip when the first and second clamping levers are moved to substantially closed positions.

Preferably, the channels comprise one or more walls formed into the end caps.

Preferably, the first and second clamping levers are releasably secured to the channels on the first and second end caps.

Preferably, at least one locking member on the first clamping lever and the second clamping lever that releasably secures the clamping levers.

Preferably, at least one locking member on the first clamping lever and the second clamping lever that include a stem and a hook that snap fit to the end caps.

Preferably, at least one locking member on the first clamping lever and the second clamping lever that includes a stem and a hook that snap fit to the first and second clamping levers.

Preferably, stops provided on the first and second clamping levers that limit rotation of the clamping levers in an open direction.

Preferably, the clamping surfaces on the first and second clamping levers are off center with respect to an axis of rotation of the clamping levers.

Preferably, an underside of the first and second clamping levers includes a plurality of ribs that increase the rigidity of the first and second clamping levers.

Preferably, an underside of the first and second clamping levers includes a plurality of ribs that form lattice structures that increase the rigidity of the first and second clamping levers.

Preferably, the first and second clamping levers further comprise:

a) first sections, second sections, and flex areas, wherein the flex areas flexibly join the first sections to the second sections;

b) the first sections include the clamping surfaces and are releasably secured to the end caps when the first and second clamping levers are moved to the substantially closed positions; and c) the second sections are releasably secured to the first sections when the first and second clamping levers are moved to the substantially closed positions.

Preferably, the rodless cylinder, wherein:

a) the first and second clamping levers further include first sections, second sections, and flex areas, wherein the flex areas flexibly join the first sections to the second sections;

b) the first sections include the clamping surfaces and are releasably secured to the end caps when the first and second clamping levers are moved to the substantially closed positions;

c) the second sections are releasably secured to the first sections when the first and second clamping levers are moved to the substantially closed positions; and d) the channels on the first and second end caps are provided with at least one overhang that extends over the second sections of the first and second clamping levers.

Preferably, the first and second clamping levers further comprise:

a) first sections, second sections, and flex areas, wherein the flex areas flexibly join the first sections to the second sections;

b) the first sections include the clamping surfaces and first and second locking members that include stems and hooks, wherein the first and second locking members on the first sections are releasably secured to the channels when the first and second clamping levers are moved to the substantially closed positions; and c) the second sections include third and fourth locking members that include stems and hooks, wherein the third and fourth locking members on the second sections are releasably secured to the first sections when the first and second clamping levers are moved to the substantially closed positions.

Preferably, the rodless cylinder, wherein:

a) the first and second clamping levers include first sections, second sections, and flex areas, wherein the flex areas flexibly join the first sections to the second sections;

b) the first sections include the clamping surfaces and first and second locking members that include stems and hooks, wherein the first and second locking members on the first sections are releasably secured to the channels when the first and second clamping levers are moved to the substantially closed positions;

c) the second sections include third and fourth locking members that include stems and hooks, wherein the third and fourth locking members on the second sections are releasably secured to the first sections when the first and second clamping levers are moved to the substantially closed positions; and d) the channels on the first and second end caps are provided with at least one overhang that extends over the second sections of the first and second clamping levers.

DETAILED DESCRIPTION OF THE PRESENTLY PREFERRED EMBODIMENTS

Figure 1:
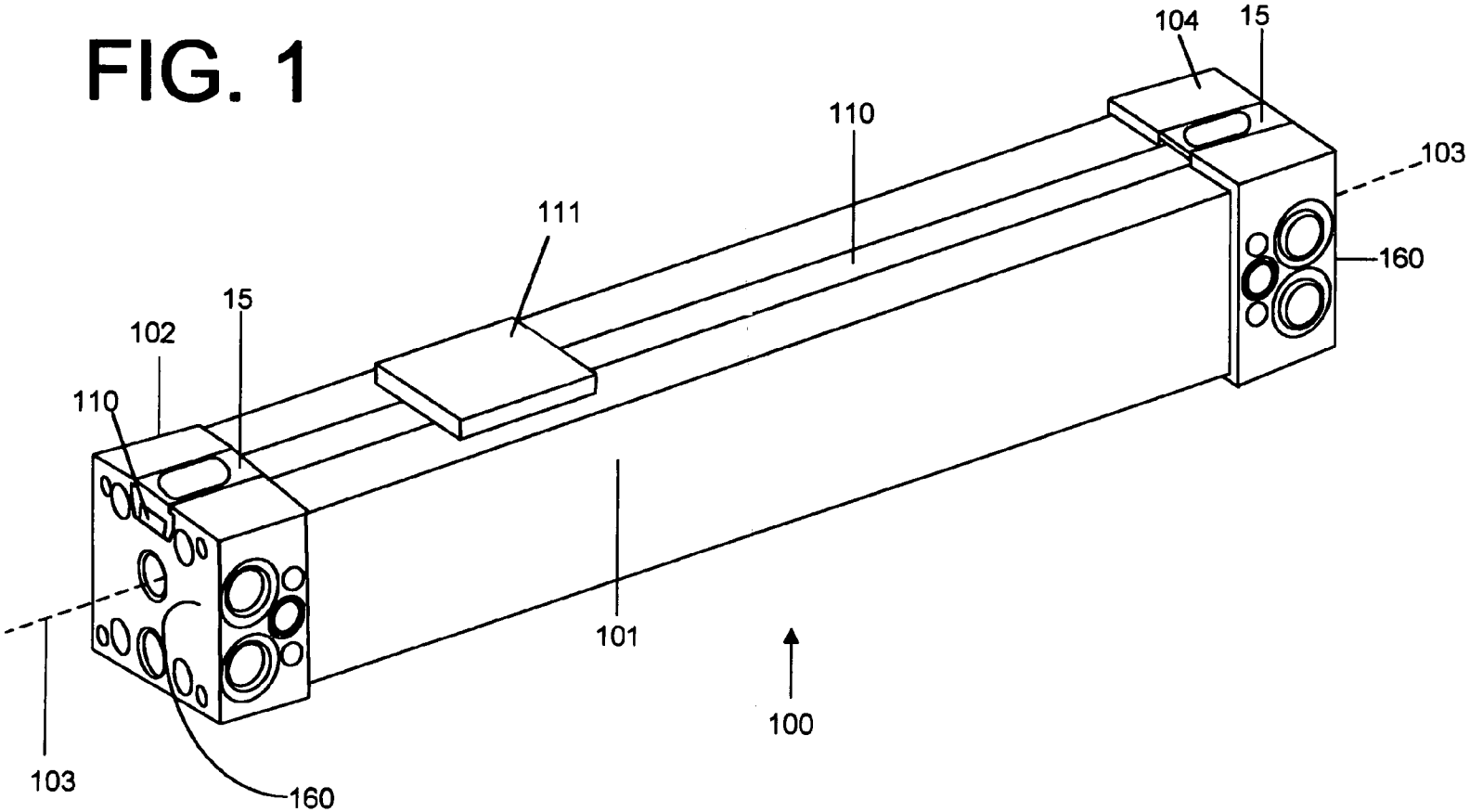
FIG. 1 depicts a perspective view of a rodless cylinder including end caps and clamping levers according to the presently preferred embodiment of the present invention.

Turning now to FIG. 1, a rodless cylinder 100 is shown, which embodies features of the presently preferred embodiment. As shown, the rodless cylinder includes a cylinder body 101, a seal 110, a slider 111, a first end cap 102, and a second end cap 104. As shown, the end caps 102, 104 are provided with clamping levers 15.

According to one aspect of the present embodiment, the end caps 102, 104 are configured to cooperate with clamping levers 15 to clamp the sealing strip 110. According to another aspect of the presently preferred embodiment, the end caps 102, 104 are configured to cooperate with clamping levers 15 so that a tension force is placed on the sealing strip 110. Advantageously, clamping levers 15 are pivotally mounted to the end caps 102, 104, whereby the clamping levers 15 are rotatable from an open position to a closed position, whereat they clamp and place the sealing strip 110 under tension.

Figure 2:
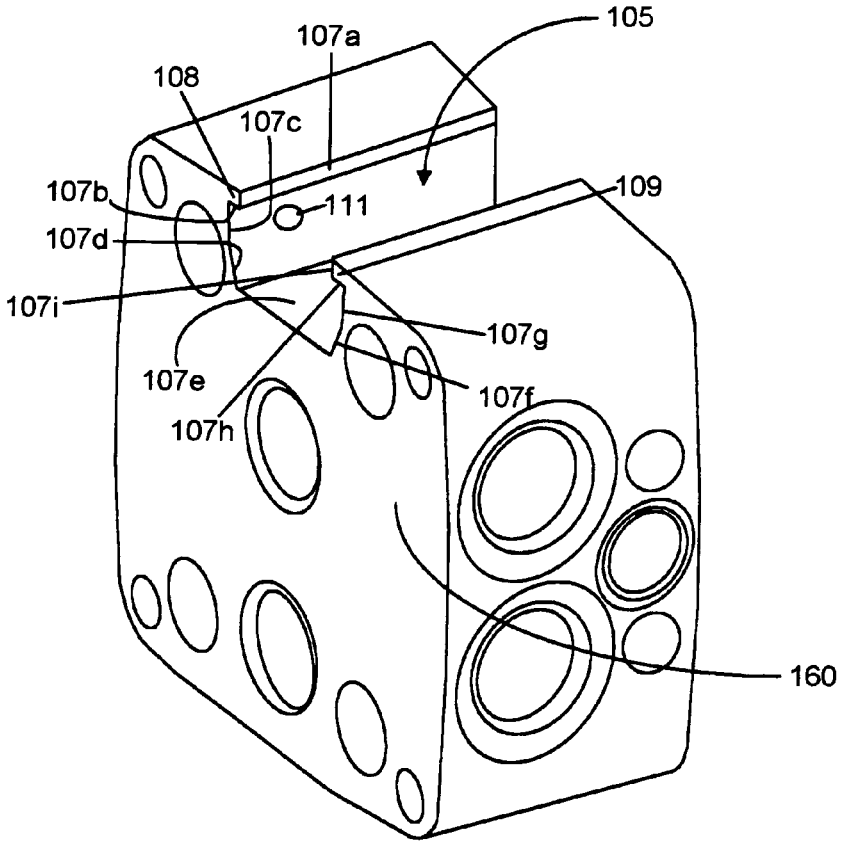
FIG. 2 depicts a perspective view of an end cap of the presently preferred embodiment.

As shown in FIG. 2, the first and second end caps 102, 104 of the presently preferred embodiment define channels 105. The channels 105 are positioned so that when the first and second end caps 102, 104 are mounted on the rodless cylinder 100, the channels 105 extends substantially in the same direction as the axis of the 103 (shown in FIG. 1) of the rodless cylinder 100. According to one aspect of the presently preferred embodiment, the channels 105 are shaped to receive the sealing strip 110. According to another aspect of the presently preferred embodiment, the channels 105 are shaped to receive clamping levers 15.

Figure 10:
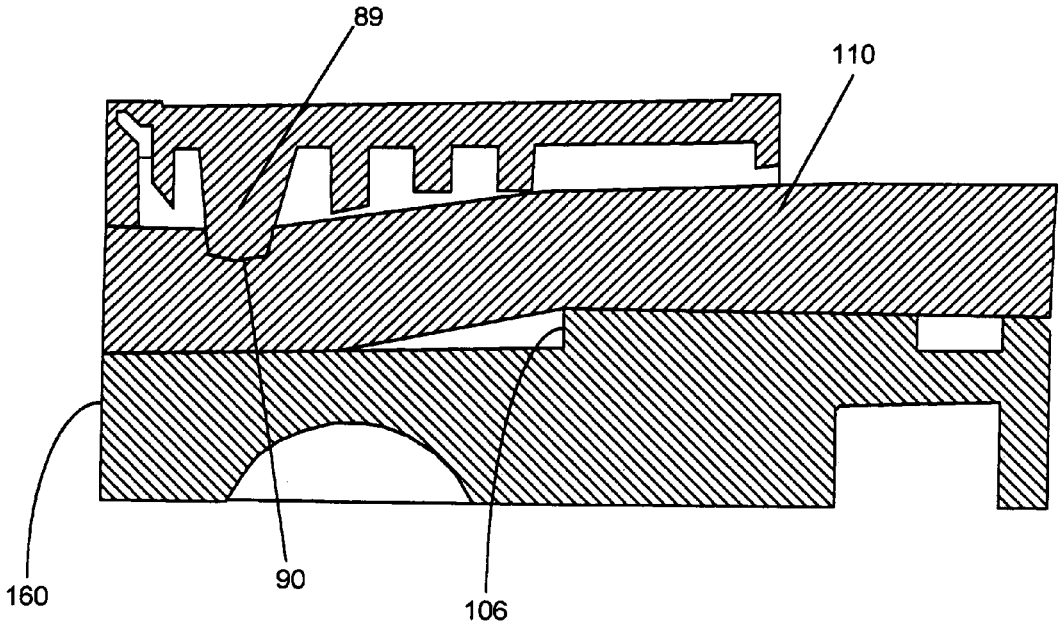
FIG. 10 is a perspective view of a clamping lever, end cap, and seal of the presently preferred embodiment showing the clamping lever clamping the sealing strip.

In the presently preferred embodiment, the channels 105 are defined by a plurality of walls 107*a*-107*i*. The walls 107*a*-107*i* are shaped to receive the sealing strip 110 and clamping levers 15. As shown in FIG. 10, the walls 107*e*, which in the embodiment depicted function as bases of the channels 105, are preferably provided with stepped surfaces 106. Although in the presently preferred embodiment, the channels 105 are defined walls 107*a*-107*i*, those of ordinary skill in the art will appreciate that it is within the scope of the present invention to provide one wall or any number of walls. By way of example, and not limitation, the channels 105 can be defined by one continuously generally curved surface. Additionally, the walls 107*e* of the channels 105 can be fabricated without the step surfaces 106 or provided with a plurality of stepped surfaces 106.

Figure 4:
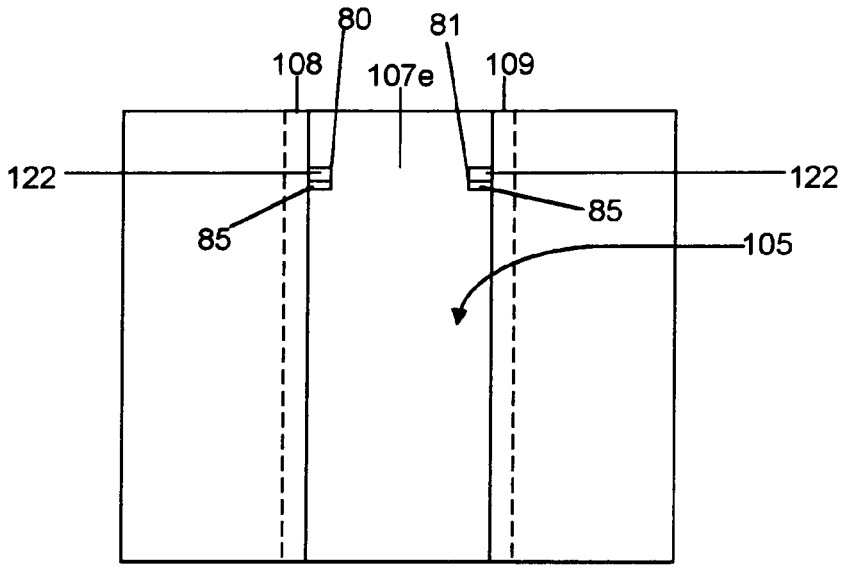
FIG. 4 depicts a top view of an end cap of the presently preferred embodiment.
Figure 5:
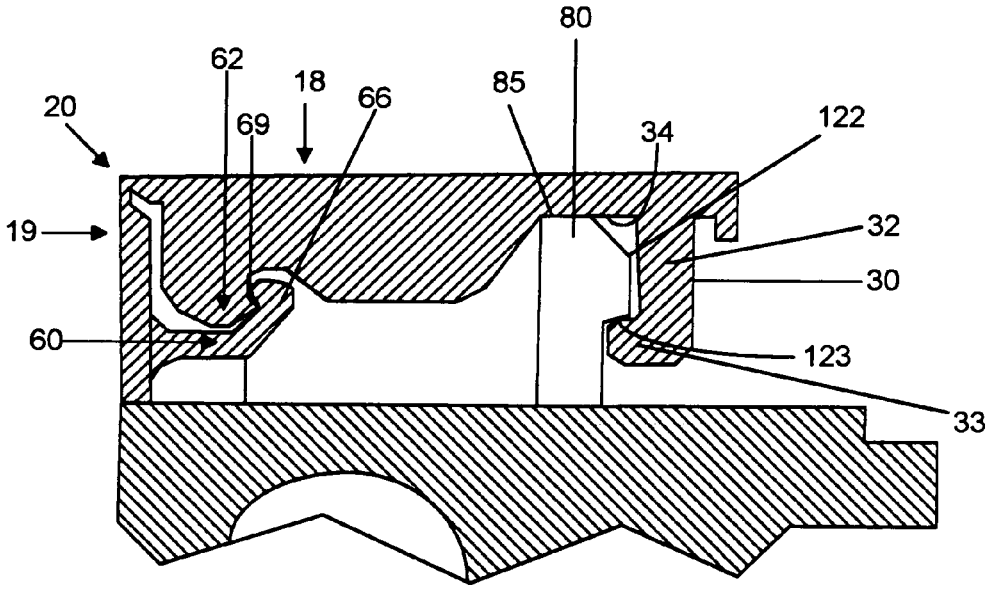
FIG. 5 depicts a side view, partially in section, of an end cap and a clamping lever of the presently preferred embodiment showing the clamping lever in a closed position.

According to one aspect of the presently preferred embodiment, the channels 105 are configured to releasably secure the clamping levers 15 when the clamping levers 15 are rotated to a substantially closed position. As shown in FIG. 4, located within the channels 105 are preferably first and second securing members 80, 81. In the presently preferred embodiment, the first and second securing members 80, 81 protrude from the walls 107*e* of the channels 105. Turning now to FIG. 5, the first and second securing members 80, 81 are provided with shoulders 122 and receiving surfaces 123. Advantageously, the shoulders 122 and receiving surfaces 123 are positioned and shaped so that first and second locking members 30, 31 on first sections 18 of the clamping levers 15 releasably snap fit thereto when the clamping lever 15 is in a substantially closed position. Although FIG. 5 depicts only the first locking member 30 snap fit to the first securing member 80, those of ordinary skill in the art will appreciate that in the presently preferred embodiment the second locking member 31 snap fits to the second securing member 81 in a similar manner.

As shown in FIG. 2, the channels 105 are preferably provided with first and second overhangs 108, 109. According to one aspect of the presently preferred embodiment, the first and second overhangs 108, 109 are shaped so that third and fourth locking members 60, 61 provided on the clamping levers 15 easily release from first and second securing members 62, 63 provided on the claming lever 15. Advantageously, the first and second overhands 108, 109 ensure that the third and fourth locking members 60, 61 do not follow the first and second securing members 62, 63, when the clamping levers 15 are rotated from the closed position to an open position.

Figure 3:
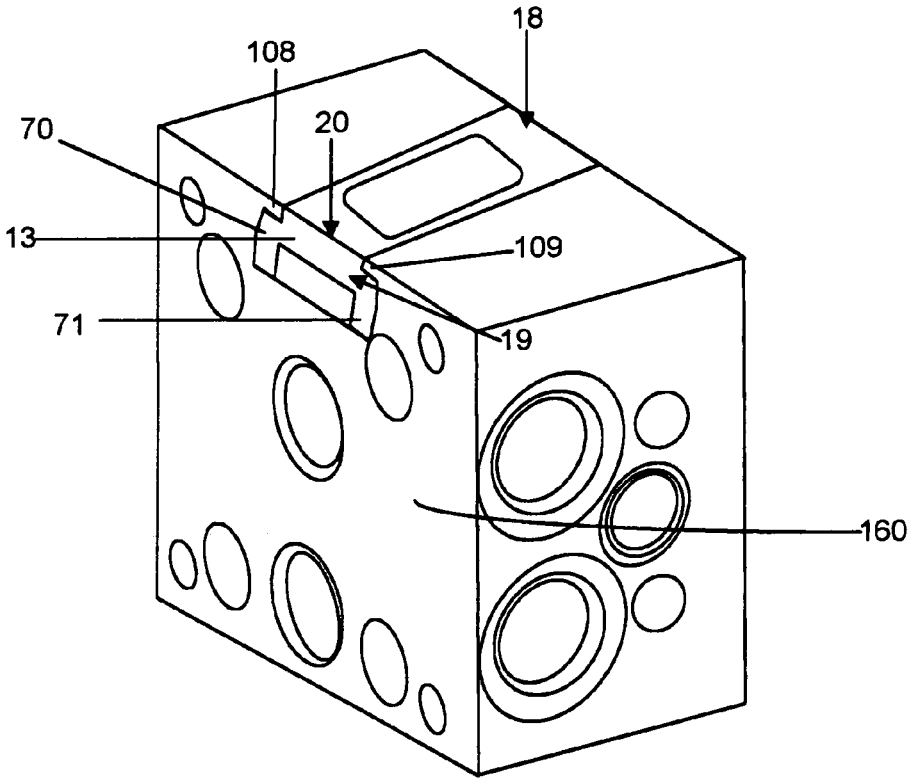
FIG. 3 depicts a perspective view of an end cap and a clamping lever of the presently preferred embodiment.
Figure 6:
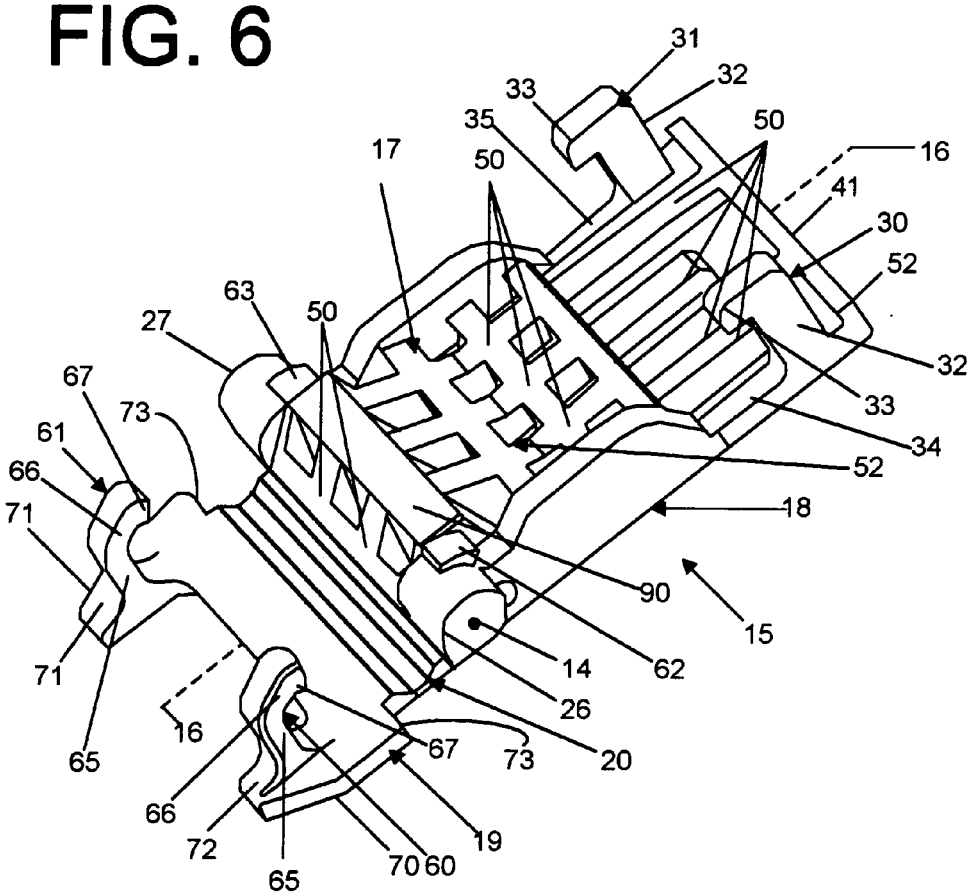
FIG. 6 is a perspective view showing an underside of a clamping lever of the presently preferred embodiment.
Figure 7:
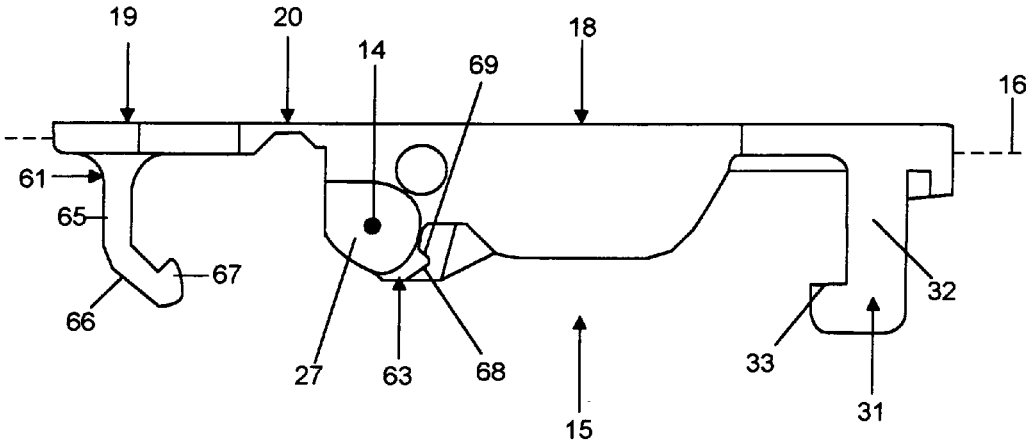
FIG. 7 is a side view of a clamping lever of the presently preferred embodiment.
Figure 8:
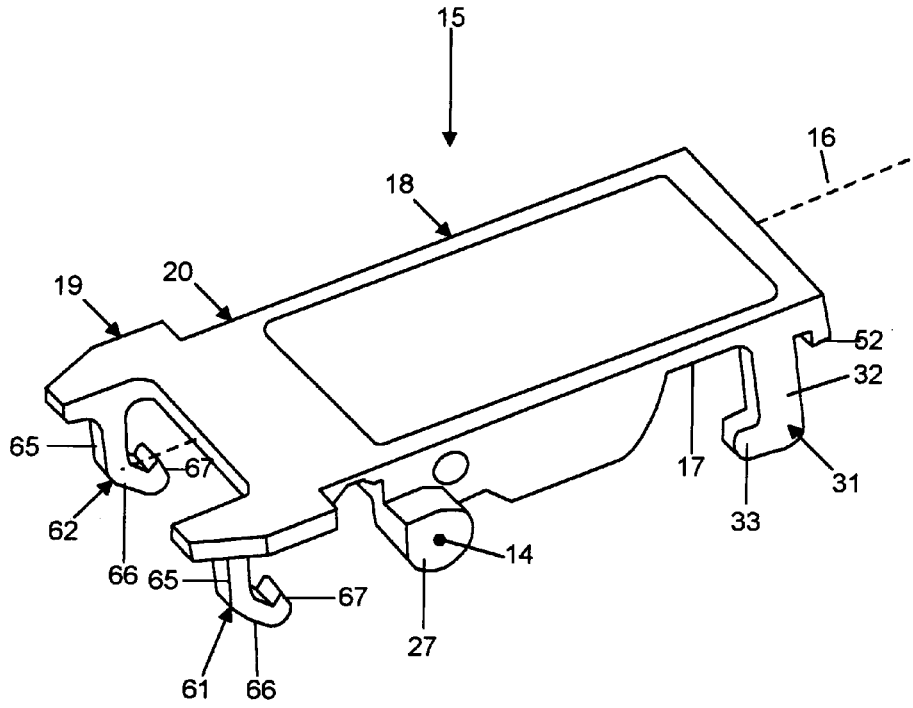
FIG. 8 is a perspective view of a clamping lever of the presently preferred embodiment.
Figure 9:
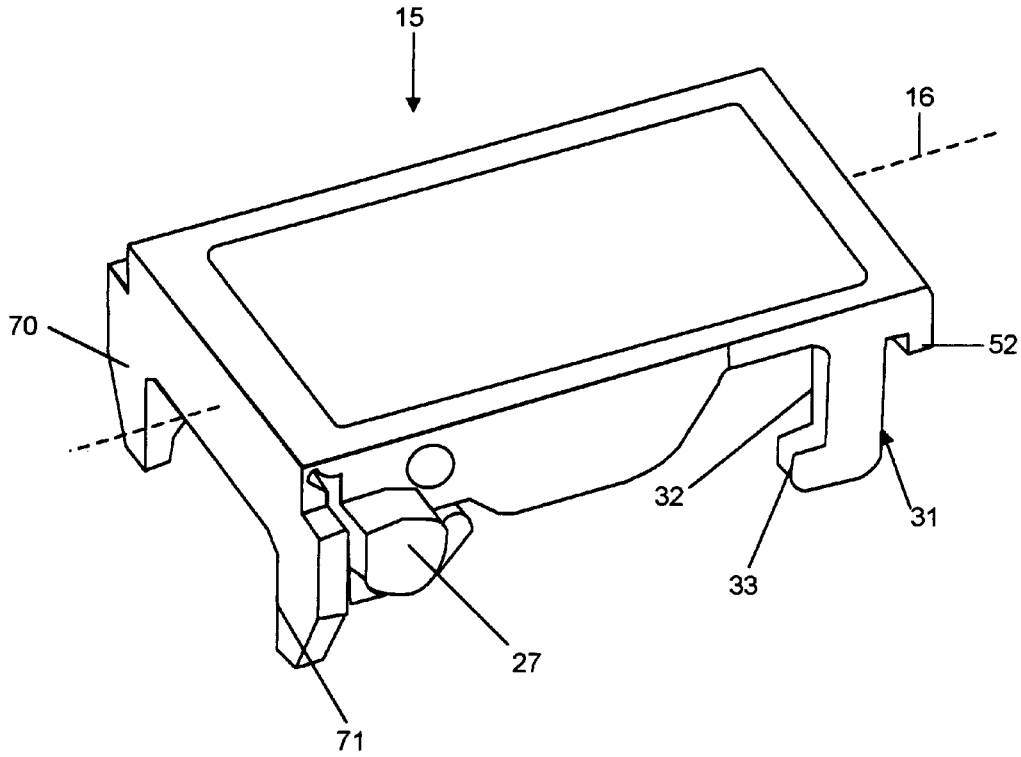
FIG. 9 is a perspective view of a clamping lever of the presently preferred embodiment, showing the clamping lever in the closed position.

As shown in FIG. 3, the overhangs 108, 109 are shaped to extend over a pair of legs 70, 71 provided on second sections 19 of the clamping levers 15. As shown in FIG. 6, located on the under sides 17 of the clamping levers 15, on inner faces 72 of the legs 70, 71, are third and fourth locking members 60, 61. When the clamping levers 15 are in a substantially closed position, as shown in FIG. 5, the third and fourth locking members 60, 61 are positioned and shaped to snap fit to first and second securing members 62, 63 provided on the underside 17 of the clamping lever 15. As shown in FIG. 3, when the third and fourth locking members 60, 61 are snap fit, the outer surface 13 of a second section 19 of the clamping member 15 is preferably positioned substantially flush with the end faces 160 of the end caps 102, 104. Although FIG. 5 depicts only the third locking member 60 snap fit to the first securing member 62, those of ordinary skill in the art will appreciate that in the presently preferred embodiment the fourth locking member 61 snap fits to the second securing member 63 in a similar manner.

According to one aspect of the presently preferred embodiment, the third and fourth locking members 60, 61 are releasably secured to the first and second securing members 62, 63. In the preferred embodiment the third and fourth locking members 60, 61 are configured to be manually released from the first and second securing members 62, 63 as the clamping levers 15 are moved toward an open position; however, in an alternative embodiment, the locking members 60, 61 may be configured to automatically release from the first and second securing members 62, 63 as the clamping levers 15 are moved toward an open position.

According to another aspect of the presently preferred embodiment, the channels 105 are configured so that the clamping levers 15 are pivotally mounted within the channels 105. In the presently preferred embodiment, the channels 105 of the presently preferred embodiment include a pair of bearings, one of which is depicted as reference numeral 111 in FIG. 2. The bearings 111 are preferably defined by a generally cylindrical recess formed into one of the walls 107*a*-*h* of the channels 105. As shown in FIG. 2, the bearings 111 are defined within walls 107*c* of the channels 105. In the preferred embodiment opposing second bearings (not shown) are defined within another one of the walls, such as walls 107*f* in FIG. 2, of the channels 105. In the presently preferred embodiment, the first bearings 111 and the second bearings (not shown) are positioned to rotatably receive first and second journals 26, 27 provided on the clamping levers 15.

Although in the presently preferred embodiment, the first bearings 111 and the second bearings (not shown) rotatably receive the journals 26, 27 to provide the clamping levers 15 with an axes of rotation 14, those of ordinary skill in the art will appreciate that it is within the scope of the present invention to provide the clamping levers 15 with axes of rotation 14 via other configurations. By way of example, and not limitation, the clamping levers 15 may be provided with one or more bearings that cooperate with one or more journals provided on the channel 105.

FIGS. 6-9 depict the presently preferred embodiment of the clamping levers 15. As shown, the clamping levers 15 are provided with first sections 18, second sections 19, and flex areas 20. In the presently preferred embodiment, the flex areas 20 flexibly connect the first and second sections 18, 19.

According to one aspect of the presently preferred embodiment, the clamping levers 15 are configured to pivotally mount to the first and second end caps 102, 104. As shown in FIGS. 6-9, the clamping levers 15 are preferably provided with first and second journals 26, 27, which in the presently preferred embodiment are located on the first sections 18. The first and second journals 26, 27 are shaped to be received in the respective first bearings 111 and second bearings (not shown) in the channels 105. In the embodiment depicted, the journals 26, 27 are generally cylindrical in shape and extend from opposite sides of the clamping lever in directions that are generally orthogonal with respect to the axes 16 of the clamping levers 15.

According to one aspect of the presently preferred embodiment, the clamping levers 15 are configured to be releasably secured to the end caps 102, 104. As shown in FIGS. 6-9, in the presently preferred embodiment, the undersides 17 of the clamping levers 15 are provided with first and second locking members 30, 31, which in the presently preferred embodiment are located on the first sections 18. As shown in FIG. 5, the first and second locking members 30, 31 are shaped and positioned to be releasably secured to the first and second securing members 80, 81 provided in the channels 105. As shown, in the presently preferred embodiment, the first and second locking members 30, 31 include stems 32 and hooks 33 that snap fit to the first and second securing members 80, 81. As shown in FIG. 5, when the first and second locking members 30, 31 are releasably secured, the hooks 33 fit under the receiving surfaces 123 on the securing members 80, 81.

Preferably, as shown in FIGS. 5 and 6, the undersides 17 of the clamping levers 15 are provided with first and second contact surfaces 34, 35, which are positioned in substantial contact the upper faces 85 of the first and second securing members 80, 81 when the first and second locking members 30, 31 are releasably secured. In the presently preferred embodiment, the first and second contact surfaces 34, 35 function as stops that limit rotation of the clamping levers 15 in a closed direction.

According to another aspect of the presently preferred embodiment, the first sections 18 of the clamping levers 15 are configured to be releasably secured to the second sections 19 of the clamping levers 15. As shown in FIGS. 6-9 located on the undersides 17 of the clamping levers 15 are third and fourth locking members 60, 61 and first and second securing members 62, 63. As shown, the third and fourth locking members 60, 61 are provided with a first stem 65, a second stem 66, and a hook 67. In the embodiment depicted, the stems 66 extend at an angle from the first stems 65. Also shown in FIG. 7, the first and second securing members 62, 63 are provided with a shoulder 68 and a receiving surface 69.

In the preferred embodiment, the third and fourth locking members 60, 61 are located on the second sections 19 and the first and second securing members 62, 63 are located on the first sections 18 of the clamping levers 15. Advantageously, the flex areas 20 allow the first and second sections 18, 19 to rotate relative to each other, whereby, as shown in FIG. 5, the third and fourth locking members 60, 61 contact and snap fit to first and second securing members 62, 63. As shown, when the third and fourth locking members 60, 61 are releasably secured, the hooks 67 extend over the receiving surfaces 69. Although FIG. 5 depicts only the third locking member 60 snap fit to the first securing member 62, those of ordinary skill in the art will appreciate that in the presently preferred embodiment the fourth locking member 61 snap fits to the second securing member 63 in a similar manner.

According to one aspect of the presently preferred embodiment, the undersides 17 of the first sections 18 on the clamping levers 15 are configured to provide increased rigidity to the clamping levers 15. As shown in FIG. 6, in the presently preferred embodiment, the undersides 17 are provided with a plurality of ribs 50. In the preferred embodiment depicted, the undersides 17 include a plurality of axially extending ribs 50, which preferably extend from lips 52 formed at the inner ends 41 of the clamping levers 15. Also shown in the preferred embodiment depicted, the undersides 17 are provided with a plurality of ribs 50 that form lattice structures 52 on the clamping levers 15.

According to one aspect of the present embodiment, the clamping levers 15 are configured to clamp the sealing strip 110. According to another aspect of the presently preferred embodiment the clamping levers 15 are configured to apply a tension force to the sealing strip 110. As shown in FIG. 6, the undersides 17 of the first sections 18 of the clamping levers 15 are provided with clamping surfaces 90. In the presently preferred embodiment, the clamping surfaces 90 are located at the end of lobes 89 (shown in FIG. 10) and are positioned to be off center or eccentrically positioned with respect to the axes of rotation 14 of the first sections 18. In the presently preferred embodiment, the clamping surfaces 90 are slightly rounded. Although in the presently preferred embodiment, clamping surfaces 90 are provided with slightly rounded shape, those of ordinary skill in the art will appreciate that it is within the scope of present invention to provide the clamping surfaces 90 with other shapes. By way of example, and not limitation, the clamping surfaces 90 may include pointed surfaces and/or textured surfaces.

FIG. 10 shows a clamping lever 15 rotating toward a substantially closed position, in response to a force applied on the inner end of the clamping lever 15 in the direction of the sealing strip 110. According to one aspect of the presently preferred embodiment, when the clamping levers 15 are rotated toward a closed position, the clamping surfaces 90 contact the upper face of the sealing strip 110 and clamp the sealing strip 110 within the channels 105. According to another aspect of the presently preferred embodiment, when the clamping levers 15 are rotated toward a closed position, the clamping surfaces 90 contact the sealing strip 110 and induce axial movement in the sealing strip 110 towards the end face 160 of the end caps 102, 104. Accordingly, when the clamping levers 15 are rotated toward a closed position, the pair of clamping levers 15 induce axial tension in the sealing strip 110. As the rotation continues, the amount of tension and clamping force increases until a sufficient amount is achieved, whereupon, the contact surfaces 34, 35 contact the upper faces 85 of the securing members 80, 81 and the retaining members 30, 31 and 60, 61 snap fit to the securing members 80, 81 and 62, 63.

In the presently preferred embodiment, the end caps 102, 104 are fabricated from an aluminum that is pressure die cast and the clamping levers 15 are fabricated from a plastic. However, it is within the scope of the present invention to fabricate the end caps 102, 104 and clamping levers 15 using any suitable means or materials. By way of example, and not limitation, the end caps 102, 104 may be fabricated by machining.

Figure 11:
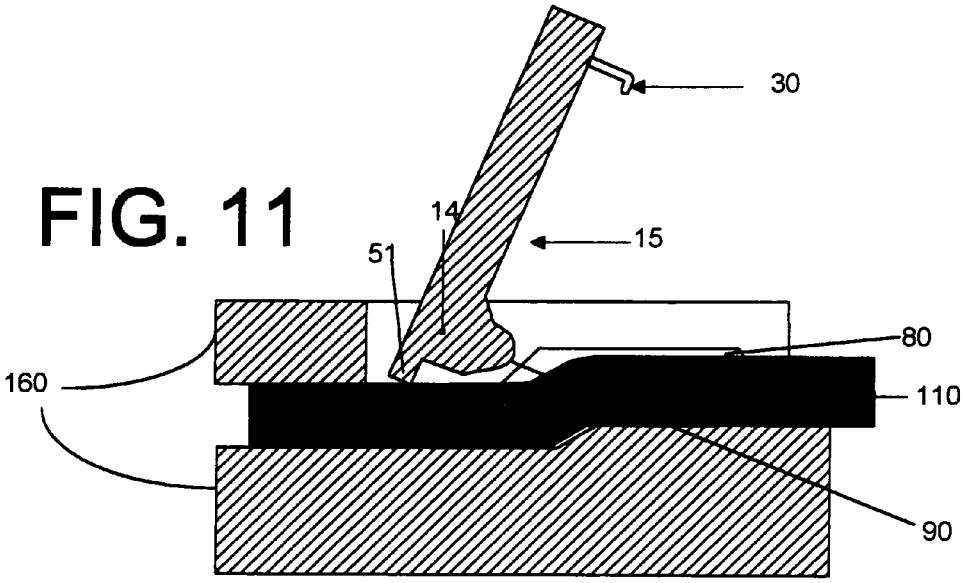
FIG. 11 depicts a sectional view of a clamping lever of an alternative embodiment of the present invention in an open position.
Figure 12:
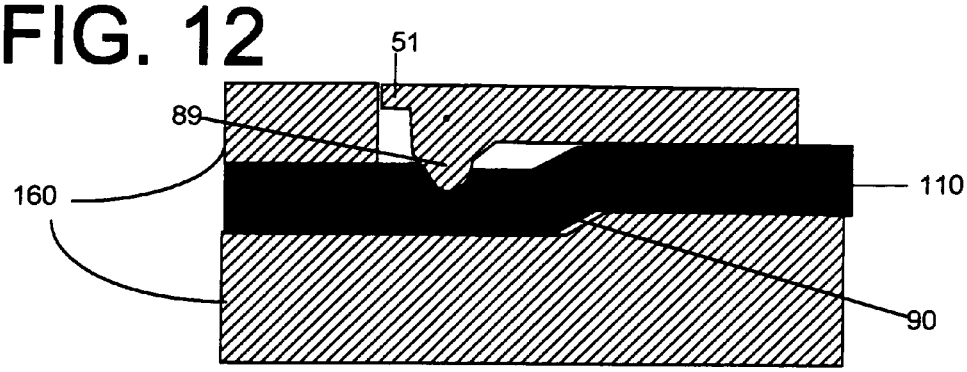
FIG. 12 depicts a sectional view of a clamping lever of an alternative embodiment of the present invention in a closed position.

Although in the presently preferred embodiment, the clamping levers 15 are provided with first sections 18, second sections 19, and flex areas 20, the scope of the present invention is not so limited. By way of example, and not limitation, FIGS. 11 and 12 depict an alternative embodiment that does not include the second section 19 and the flex area 20. As shown, the outer end of the clamping lever may be provided with a stop 51 that limits rotation of the clamping lever 15 as the clamping lever is rotated toward the open position.

While this invention has been particularly shown and described with references to various embodiments thereof, it will be understood by those skilled in the art that various changes in form and details may be made therein without departing from the spirit and scope of the invention as defined by the appended claims. For the purpose of teaching preferred principles, some conventional aspects have been simplified or omitted. Those skilled in the art will appreciate variations from these examples that fall within the scope of the invention. Those skilled in the art will appreciate that the features described above can be combined in various ways to form multiple variations of the invention. As a result, the invention is not limited to the specific examples described above, but only by the claims and their equivalents.

We claim:

1. An end cap for a rodless cylinder including a sealing strip, the end cap comprising:

a) an end cap body (102, 104) configured to sealingly fit to a cylinder body (101);

b) a channel (105) formed in the end cap body (102, 104) and adapted to receive the sealing strip (110); and c) a clamping lever (15) pivotally affixed to the end cap body (102, 104), with the clamping lever (15) including a clamping surface (90) that, at least partially, clamps the sealing strip (110) within the channel (105) when the clamping lever (15) is moved to a substantially closed position and one or more locking members (30, 31, 60, 61) that releasably secure the clamping lever (15), wherein at least one of the one or more locking members (30, 31) on the clamping lever (15) includes a stem (32) and a hook (33) that snap fit to the end cap (102).

2. The end cap for a rodless cylinder according to claim 1, wherein the channel (105) comprises one or more walls (107*a*, 107*b*, 107*c*, 107*d*, 107*e*, 107*f*, 107*g*, 107*h*) formed into the end cap (102).

3. The end cap for a rodless cylinder according to claim 1, wherein the clamping lever (15) is releasably secured to the channel (105) on the end cap (102).

4. The end cap for a rodless cylinder according to claim 1, wherein the locking member (60, 61) includes a stem (65, 66) and a hook (67) that snap fit to the clamping lever (15).

5. The end cap for a rodless cylinder according to claim 1, further comprising a stop (34, 35) provided on the clamping lever (15) that limits rotation of the clamping lever (15) in a closed direction.

6. The end cap for a rodless cylinder according to claim 1, wherein the clamping surface (90) is off center with respect to an axis of rotation (14) of the clamping lever (15).

7. The end cap for a rodless cylinder according to claim 1, wherein the clamping lever (15) places a tension force on the sealing strip (110) when moved to the substantially closed position.

8. The end cap for a rodless cylinder according to claim 1, wherein an underside (17) of the clamping lever (15) includes a plurality of ribs (50) that increase the rigidity of the clamping lever (15).

9. The end cap for a rodless cylinder according to claim 1, wherein an underside (17) of the clamping lever (15) includes a plurality of ribs (50) that form a lattice structure (52) that increases the rigidity of the clamping lever (15).

10. The end cap for a rodless cylinder according to claim 1, wherein the clamping lever further comprises:

a) a first section (18), a second section (19), and a flex area (20), wherein the flex area (20) flexibly joins the first section (18) to the second section (19);

b) the first section (18) includes the clamping surface (19) and is releasably secured to the end cap (102) when the clamping lever (15) is moved to the substantially closed position; and c) the second section (19) is releasably secured to the first section (18) when the clamping lever (15) is moved to the substantially closed position.

11. The end cap for a rodless cylinder according to claim 1, wherein:

a) the clamping lever includes a first section (18), a second section (19), and a flex area (20), wherein the flex area (20) flexibly joins the first section (18) to the second section (19);

b) the first section (18) includes the clamping surface (90) and is releasably secured to the end cap (102) when the clamping lever (15) is moved to the substantially closed position;

c) the second section (19) is releasably secured to the first section (18) when the clamping lever (15) is moved to the substantially closed position; and d) the channel (105) is provided with at least one overhang (108, 109) that extends over the second section (19) of the clamping lever (15).

12. The end cap for a rodless cylinder according to claim 1, wherein the clamping lever further comprises:

a) a first section (18), a second section (19), and a flex area (20), wherein the flex area (20) flexibly joins the first section (18) to the second section (19);

b) the first section (18) includes the clamping surface (90) and first and second locking members (30, 31) that include stems (32) and hooks (33), wherein the first and second locking members (30, 31) releasably secure the clamping lever (15) to the channel (105) when the clamping lever is moved to the substantially closed position; and c) the second section (19) includes third and fourth locking members (60, 61) that include stems (65, 66) and hooks (67), wherein the third and fourth locking members (60, 61) releasably secure the second section (19) to the first section (18) when the clamping lever (15) is moved to the substantially closed position.

13. The end cap for a rodless cylinder according to claim 1, wherein:

a) the clamping lever (15) includes a first section (18), a second section (19), and a flex area (20), wherein the flex area (20) flexibly joins the first section (18) to the second section (19);

b) the first section (18) includes the clamping surface (90) and first and second locking members (30, 31) that include stems (32) and hooks (33), wherein the first and second locking members (30, 31) releasably secure the clamping lever (15) to the channel (105) when the clamping lever is moved to the substantially closed position;

c) the second section (19) includes third and fourth locking members (60, 61) that include stems (65, 66) and hooks (67), wherein the third and fourth locking members (60, 61) releasably secure the second section (19) to the first section (18) when the clamping lever (15) is moved to the substantially closed position; and d) the channel (105) is provided with at least one overhang (108, 109) that extends over the second section (19) of the clamping lever (15).

14. A rodless cylinder, comprising:

a) a cylinder body (101) provided with a first end, a second end, and a slot;

b) a sealing strip (11) configured to substantially seal the slot;

c) first and second end caps (102, 104) sealingly fitted to the first and second ends of the cylinder body (101), wherein:

i) first and second channels (105) are formed in the first and second end caps (102, 104) and are configured to receive the sealing strip (110); and ii) first and second clamping levers (15) are pivotally affixed to the first and second end caps (102, 104) and include clamping surfaces (90) that, at least partially, clamp the sealing strip (110) within the channels (105) when the first and second clamping levers (15) are moved to substantially closed positions and one or more locking members (30, 31, 60, 61) that releasably secure the clamping lever (15), wherein the locking member (30, 31) includes a stem (32) and a hook (33) that snap fit to the end caps (102, 104).

15. The rodless cylinder according to claim 14, wherein the channels (105) comprise one or more walls (107*a*, 107*b*, 107*c*, 107*d*, 107*e*, 107*f*, 107*g*, 107*h*) formed into the end caps.

16. The rodless cylinder according to claim 14, wherein the first and second clamping levers (15) are releasably secured to the channels (105) on the first and second end caps (102, 104).

17. The rodless cylinder according to claim 14, wherein the locking member (60, 61) includes a stem (65, 66) and a hook (67) that snap fit to the first and second clamping levers (15).

18. The rodless cylinder according to claim 14, further comprising stops (51) provided on the first and second clamping levers (15) that limit rotation of the clamping levers (15) in an open direction.

19. The rodless cylinder according to claim 14, wherein the clamping surfaces (90) on the first and second clamping levers (15) are off center with respect to an axis of rotation (14) of the clamping levers (15).

20. The rodless cylinder according to claim 14, wherein an underside (17) of the first and second clamping levers (15) include a plurality of ribs (50) that increase the rigidity of the first and second clamping levers (15).

21. The rodless cylinder according to claim 14, wherein an underside (17) of the first and second clamping levers (15) include a plurality of ribs (15) that form lattice structures (52) that increase the rigidity of the first and second clamping levers (15).

22. The rodless cylinder according to claim 14, wherein the first and second clamping levers further comprise:

a) first sections (18), second sections (19), and flex areas (20), wherein the flex areas (20) flexibly join the first sections (18) to the second sections (19);

b) the first sections (18) include the clamping surfaces (90) and are releasably secured to the end caps (102, 104) when the first and second clamping levers (15) are moved to the substantially closed positions; and c) the second sections (19) are releasably secured to the first sections (18) when the first and second clamping levers (15) are moved to the substantially closed positions.

23. The rodless cylinder according to claim 14, wherein:

a) the first and second clamping levers (15) further include first sections (18), second sections (19), and flex areas (20), wherein the flex areas (20) flexibly join the first sections (18) to the second sections (19);

b) the first sections (18) include the clamping surfaces (90) and are releasably secured to the end caps (102, 104) when the first and second clamping levers (15) are moved to the substantially closed positions;

c) the second sections (19) are releasably secured to the first sections (18) when the first and second clamping levers (15) are moved to the substantially closed positions; and d) the channels (105) on the first and second end caps (102, 104) are provided with at least one overhang (108, 109) that extends over the second sections (19) of the first and second clamping levers (15).

24. The rodless cylinder according to claim 14, wherein the first and second clamping levers further comprise:

a) first sections (18), second sections (19), and flex areas (20), wherein the flex areas (20) flexibly join the first sections (18) to the second sections (19);

b) the first sections (18) include the clamping surfaces (90) and first and second locking members (30, 31) that include stems (32) and hooks (33), wherein the first and second locking members (30, 31) on the first sections (18) are releasably secured to the channels (105) when the first and second clamping levers (15) are moved to the substantially closed positions; and c) the second sections (19) include third and fourth locking members (60, 61) that include stems (65, 66) and hooks (67), wherein the third and fourth locking members (60, 61) on the second sections (19) are releasably secured to the first sections (18) when the first and second clamping levers (15) are moved to the substantially closed positions.

25. The rodless cylinder according to claim 14, wherein:

a) the first and second clamping levers (15) include first sections (18), second sections (19), and flex areas (20), wherein the flex areas (20) flexibly join the first sections (18) to the second sections (19);

b) the first sections (18) include the clamping surfaces (90) and first and second locking members (30, 31) that include stems (32) and hooks (33), wherein the first and second locking members (30, 31) on the first sections (18) are releasably secured to the channels (105) when the first and second clamping levers (15) are moved to the substantially closed positions;

c) the second sections (19) include third and fourth locking members (60, 61) that include stems (65, 66) and hooks (67), wherein the third and fourth locking members on the second sections (19) are releasably secured to the first sections (18) when the first and second clamping levers (15) are moved to the substantially closed positions; and d) the channels on the first and second end caps (102, 104) are provided with at least one overhang (108, 109) that extends over the second sections (19) of the first and second clamping levers (15).

26. A rodless cylinder, comprising:

a) a cylinder body (101) provided with a first end, a second end, and a slot;

b) a sealing strip (110) configured to substantially seal the slot;

c) first and second end caps (102, 104) sealingly fitted to the first and second ends of the cylinder body (101), wherein:

i) first and second channels (105) are formed in the first and second end caps (102, 104) and are configured to receive the sealing strip (110); and ii) first and second clamping levers (15) are pivotally affixed to the first and second end caps (102, 104) and include clamping surfaces (90) that, at least partially, clamp the sealing strip (110) within the channels (105) and apply tension to the sealing strip (110) when the first and second clamping levers (15) are moved to substantially closed positions and one or more locking members (30, 31, 60, 61) that releasably secure the clamping lever (15).

27. The rodless cylinder according to claim 26, wherein the channels (105) comprise one or more walls (107*a*, 107*b*, 107*c*, 107*d*, 107*e*, 107*f*, 107*g*, 107*h*) formed into the end caps (102, 104).

28. The rodless cylinder according to claim 26, wherein the first and second clamping levers (15) are releasably secured to the channels (105) on the first and second end caps (102, 104).

29. The rodless cylinder according to claim 26, wherein the locking member (30, 31) includes a stem (32) and a hook (33) that snap fit to the end caps (102, 104).

30. The rodless cylinder according to claim 26, wherein the locking member (60, 61) includes a stem (65, 66) and a hook (67) that snap fit to the first and second clamping levers (15).

31. The rodless cylinder according to claim 26, further comprising stops (51) provided on the first and second clamping levers (15) that limit rotation of the clamping levers (15) in an open direction.

32. The rodless cylinder according to claim 26, wherein the clamping surfaces (90) on the first and second clamping levers (15) are off center with respect to an axis of rotation (14) of the clamping levers (15).

33. The rodless cylinder according to claim 26, wherein an underside (17) of the first and second clamping levers (15) include a plurality of ribs (50) that increase the rigidity of the first and second clamping levers (15).

34. The rodless cylinder according to claim 26, wherein an underside (17) of the first and second clamping levers (15) include a plurality of ribs (50) that form lattice structures (52) that increase the rigidity of the first and second clamping levers (15).

35. The rodless cylinder according to claim 26, wherein the first and second clamping levers further comprise:

a) first sections (18), second sections (19), and flex areas (20), wherein the flex areas (20) flexibly join the first sections (18) to the second sections (19);

b) the first sections (18) include the clamping surfaces (90) and are releasably secured to the end caps (102, 104) when the first and second clamping levers (15) are moved to the substantially closed positions; and c) the second sections (19) are releasably secured to the first sections (18) when the first and second clamping levers (15) are moved to the substantially closed positions.

36. The rodless cylinder according to claim 26, wherein:

a) the first and second clamping levers (15) further include first sections (18), second sections (19), and flex areas (20), wherein the flex areas (20) flexibly join the first sections (18) to the second sections (19);

b) the first sections (18) include the clamping surfaces (90) and are releasably secured to the end caps (102, 104) when the first and second clamping levers (15) are moved to the substantially closed positions;

c) the second sections (19) are releasably secured to the first sections (18) when the first and second clamping levers (15) are moved to the substantially closed positions; and d) the channels on the first and second end caps (102, 104) are provided with at least one overhang that extends over the second sections (19) of the first and second clamping levers (15).

37. The rodless cylinder according to claim 26, wherein the first and second clamping levers further comprise:

a) first sections (18), second sections (19), and flex areas (20), wherein the flex areas (20) flexibly join the first sections (18) to the second sections (19);

b) the first sections (18) include the clamping surfaces (90) and first and second locking members (30, 31) that include stems (32) and hooks (33), wherein the first and second locking members (30, 31) on the first sections (18) are releasably secured to the channels (105) when the first and second clamping levers (15) are moved to the substantially closed positions; and c) the second sections (19) include third and fourth locking members (60, 61) that include stems (65, 66) and hooks (67), wherein the third and fourth locking members (60, 61) on the second sections (19) are releasably secured to the first sections (18) when the first and second clamping levers (15) are moved to the substantially closed positions.

38. The rodless cylinder according to claim 26, wherein:

a) the first and second clamping levers (15) include first sections (18), second sections (19), and flex areas (20), wherein the flex areas (20) flexibly join the first sections (18) to the second sections (19);

b) the first sections (18) include the clamping surfaces (90) and first and second locking members (30, 31) that include stems (32) and hooks (33), wherein the first and second locking members (30, 31) on the first sections (18) are releasably secured to the channels (105) when the first and second clamping levers (15) are moved to the substantially closed positions;

c) the second sections (19) include third and fourth locking members (60, 61) that include stems (65, 66) and hooks (67), wherein the third and fourth locking members (60, 61) on the second sections (19) are releasably secured to the first sections (18) when the first and second clamping levers (15) are moved to the substantially closed positions; and d) the channels (105) on the first and second end caps (102, 104) are provided with at least one overhang (108, 109) that extends over the second sections (19) of the first and second clamping levers (15).

* * * * *